United States Patent [19]

Hilse et al.

[11] Patent Number: 4,561,807

[45] Date of Patent: Dec. 31, 1985

[54] PUSH-PULL MATERIAL TRANSPORT SYSTEM FOR IMPROVED TWO-PHASE FLOW

[75] Inventors: Gernot R. K. Hilse, Woodinville; Michael J. Intlekofer; David C. Auth, both of Bellevue, all of Wash.

[73] Assignee: Advanced Technology Laboratories, Inc., Bothell, Wash.

[21] Appl. No.: 548,378

[22] Filed: Nov. 3, 1983

[51] Int. Cl.[4] ..... B65G 53/30

[52] U.S. Cl. ..... 406/99; 417/477

[58] Field of Search ..... 406/96, 98, 99; 417/205, 206, 244, 430, 476, 477

[56] References Cited

U.S. PATENT DOCUMENTS

| | | | |
|---|---|---|---|
| 2,485,208 | 10/1949 | Longenecker | 417/430 |
| 3,190,321 | 6/1965 | Robinson | 417/477 X |
| 3,303,748 | 2/1967 | Duryee et al. | 417/477 |
| 3,400,983 | 9/1968 | Wessel | 406/96 |
| 4,218,197 | 8/1980 | Meyer et al. | 417/477 X |
| 4,335,994 | 6/1982 | Gurth | 406/99 X |

*Primary Examiner*—Jeffrey V. Nase
*Assistant Examiner*—Daniel R. Edelbrock
*Attorney, Agent, or Firm*—Lawrence S. Levinson; Sanford J. Asman

[57] ABSTRACT

The present invention is a pump apparatus which is adapted to move liquids which contain debris. The apparatus is adapted to operate by alternating suction and pressure, whereby any debris which becomes lodged in any orifices or conduits in the system is effectively dislodged as a consequence of the normal operation of the system.

The push-pull material transport system of the present invention includes a conduit to transport fluid from a first location to another location. The invention includes a peristaltic pump which has two heads. The first head pumps fluid from the first location to the second location, and the second head intermittently and periodically pumps fluid in the reverse direction in order to keep the conduit clear of debris.

6 Claims, 5 Drawing Figures

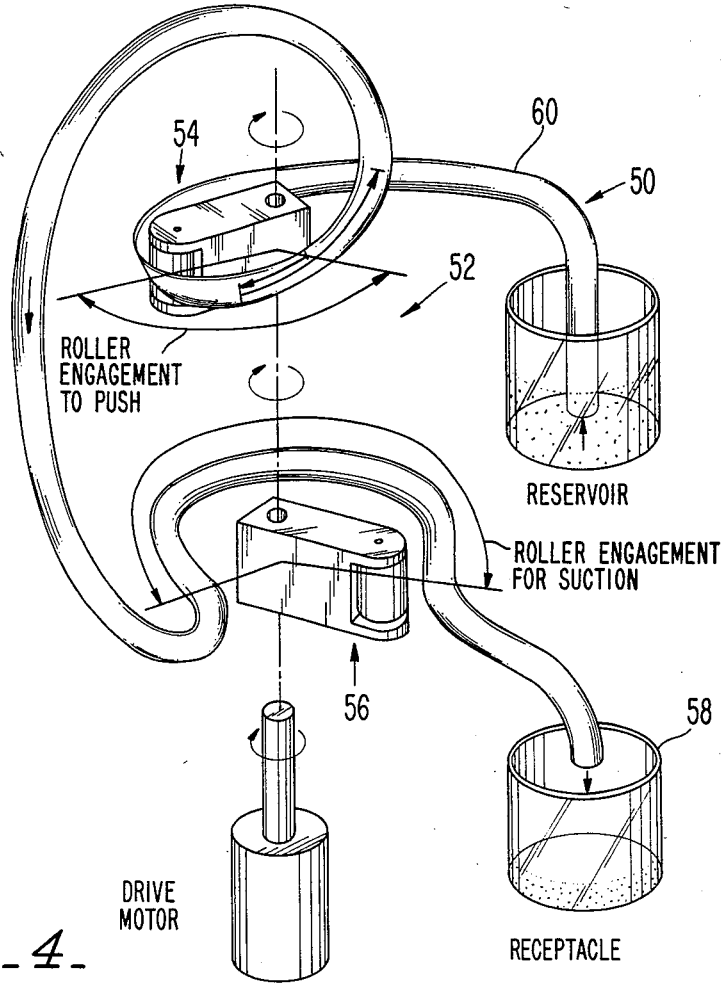
Fig. 4.
Fig. 5.
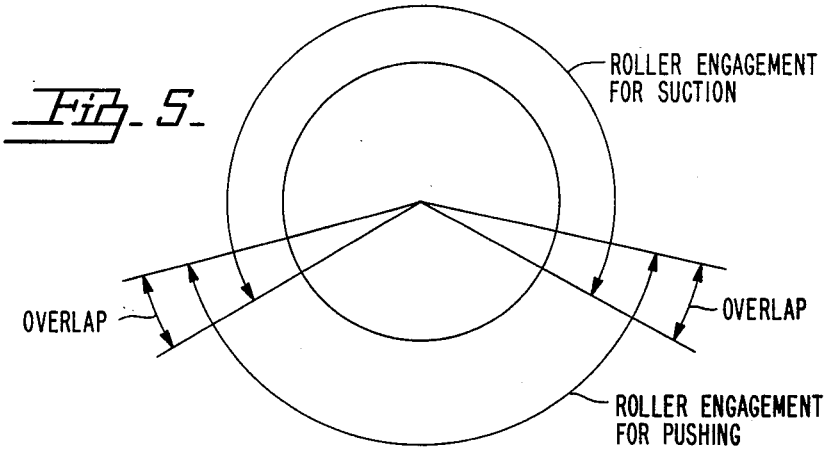

PUSH-PULL MATERIAL TRANSPORT SYSTEM FOR IMPROVED TWO-PHASE FLOW

BACKGROUND OF THE INVENTION

The present invention relates to pumps of the type used to pump debris containing liquid. In particular, the invention relates to of the type used in surgical procedures.

Transport of solid matter via a liquid carrier is sometimes referred to as two-phase flow. Increasing use of catheters to deliver energy into the body and extract debris from the body in carrying out less invasive surgical procedures increases the desirability for systems which can, without clogging, remove solid particles by better holding them in suspension in a liquid carrier.

In some surgical procedures, continuous uninterrupted contact of the surgical scalpel or appliance with the material being treated can reduce its effectiveness. The reasons for this include tissue blocking the flow of carrier fluid; the material being cut revolving or oscillating in synchrony with the cutting tip, thereby reducing or eliminating the displacement of the cutter edge relative to the material and greatly reducing cutting efficiency; the material being cut not lunging into the cutting appliance with enough velocity to enable deep bites, thereby seriously hampering cutting speed; the material being cut conforming to the shape of the cutting appliance and, thus, not providing the cutter with fresh promontories to dissect. The result of any of the above problems is reduced speed of cutting.

By way of example, suction (aspirating) tubes or catheters are frequently used in clinical practice to evacuate matter from the human body. Suction is also used to draw tissue or deposits into the operating orifice of endoscopic or percutaneous scalpels in order to improve the contact of the cutter blades with the tissue to be masticated. The various commercial appliances now available for dissection and removal of torn meniscus fragments via percutaneous artheroscopy are examples of suction enhancement of cutting and suction removal of fragments. Suction electrodes for enhancing contact with tissue before electrocoagulation or removal of blood from a lesion to be coagulated have been sold for several years. Surgeons routinely use suction tubes in open surgery to clear blood and irrigation fluids from operating sites in order to better visualize the wound. Surgeons also use suction to excapsulate tumors which have been coagulated.

In all of the foregoing procedures, there is a high likelihood of clogging the suction tube or its associated ports. In surgical procedures which require suction, the input port is frequently obstructed by a flap of tissue which occludes the input port of the suction tube. In endoscopic or percutaneous procedures, the clogging of a catheter can result in excessive clinical delays while patency is re-established.

In view of the numerous procedures in which a non-clogging pump is required, such a device would be highly desirable.

SUMMARY OF THE INVENTION

A pump which sequentially alternates extraction of fluid (via suction, i.e., "pull") and injection (via overpressure, i.e., "push") has a greatly reduced tendency to clog as it unclumps debris during the injection phase. Although the time average transport of matter is in the direction of the suction, it has been found that there can be short intervals of time when the instantaneous conduction of matter is in the direction of the injection. The oscillatory motion of the media has been found to stir up any solid matter into a slurry which can be successfully evacuated, whereas, under steady suction conditions, the same material would clog the system.

Use of the sequential bursts of injection of fluid interrupts the continuous suction and, thus, largely eliminates the problems itemized above.

BRIEF DESCRIPTION OF THE DRAWING

In the Drawing:

FIG. 4 is pictorial view of the preferred embodiment of the present invention; and FIG. 5 is a diagram showing the overlap arrangement when the present invention is used with a paristoltic pump.

DETAILED DESCRIPTION OF EXEMPLARY EMBODIMENTS

Figure 1:
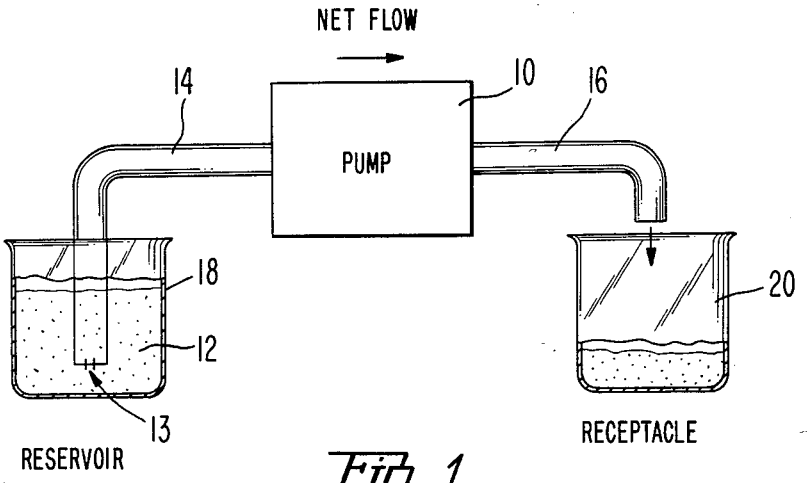
FIG. 1 is a schematic representation of a system of the type described herein.

Referring generally to FIG. 1, the present invention relates to a system which uses a pump 10 to transport fluids 12 which contain debris capable of obstructing any apertures or conduit means, such as tubes 14, 16 comprising the transportation system. Specifically, the invention provides a means for transporting fluid laden with small debris, which means functions even in the presence of a large amount of debris. The present invention is effective, because it cyclically varies the pressure in the system, causing cyclical changes in the direction of flow of the fluid 12 being transported. The fluid flows back and forth through the tubing 14, 16, but excursions towards the pump 10 (suction) are usually greater than excursions away from the pump 10 (pressure), so that the net flow is from a reservoir 18 towards a receptacle 20, as shown. If a large piece of debris should obstruct the aperture 13 during the suction phase, as will be seen, it will be blown away during the pressure phase, thereby restoring the system to full operation.

An important characteristic of the present fluid transport system, is that the maximum pressure differential that can be developed by suction is approximately 14.7 pounds per square inch (psi), while the differential that can be developed by positive pressure is unlimited, and values of 40 psi or so are easily achieved. This means that dwell times during the suction phase and the pressure phase must be carefully chosen, because the pressure phase has a tendency to dominate.

A further characteristic of the inventive fluid transport system of the invention is that the fluid conduit used is often flexible tubing 14, 16, because of its convenience, low cost, and ready availability. The tubing 14, 16 tends to collapse significantly during the suction phase, but expands only slightly during the pressure phase. The result again is to limit the efficacy during the suction phase.

The pumping device must satisfy several requirements. In particular, it must cause a cyclic pressure variation which results in a flow of fluid back and forth in the tubing 14, 16. It must have a tendency to apply the suction cycle longer than the pressure cycle, so that the net flow of fluid is from the reservoir to the receptacle. It must be compatible with the fluids and debris of interest, and it must be capable of the fluid flow rates and cyclic excursions necessary to cause back and forth motion in the tubing size being used.

Figure 2:
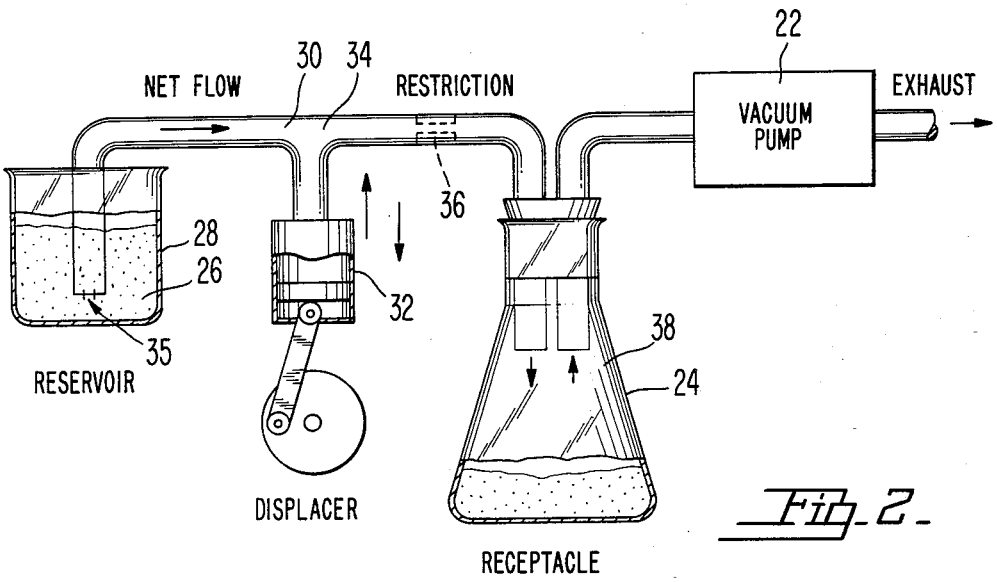
FIG. 2 is a schematic representation of a first embodiment of the present invention.

The pumping device of the present invention can be realized in several different ways. One possibility is shown in FIG. 2. In this system, a vacuum pump 22 constantly evacuates a flask 24, which causes fluid 26 to flow from the reservoir 28 through tubing 30 to the flask 24. A cyclic displacer, which may be comprised of a piston in a cylinder 32, as shown, is placed in the system via a "T" connector 34. The displacer 32 is capable of cyclically varying its volume. In the case of the displacer 32, which is shown, the volume changes are accomplished by means of a driven piston in a cylinder. However, other displacer means, such as a driven collapsible bellows, for example, could also be used. The pressure variations generated by the displacer 32 cause an alternating motion in the fluid 26 which prevents clogging at an aperture 35 or at a restriction 36. The volume displacement of the displacer 32 must be carefully chosen so that adequate back and forth motion is imparted to the fluid 26. The cycle rate of the displacer 32 must be carefully chosen so that inertial effects do not prevent proper alternating flow. Finally, the vacuum 22 pump must be regulated so that proper fluid flow is maintained. Excessive vacuum results in continuous suction, causing prompt plugging of the aperture 35 or at a restriction 36 if debris is present.

The pump shown in FIG. 2 works, but suffers from several problems. In particular, the collection flask 24 has a considerable volume 38 filled with air. Fluid shuttled by the displacer 32 tends to alternate back and forth between displacer 32 and flask 24, causing little alternate motion through the tubing 30 and at the aperture 35.

Since the pumped fluid terminates in an evacuated flask 24, it is necessary to stop the system in order to empty the flask 24 when it fills. Also, adjustment of proper suction from the vacuum pump 22 is critical and may be very difficult to achieve.

Figure 3:
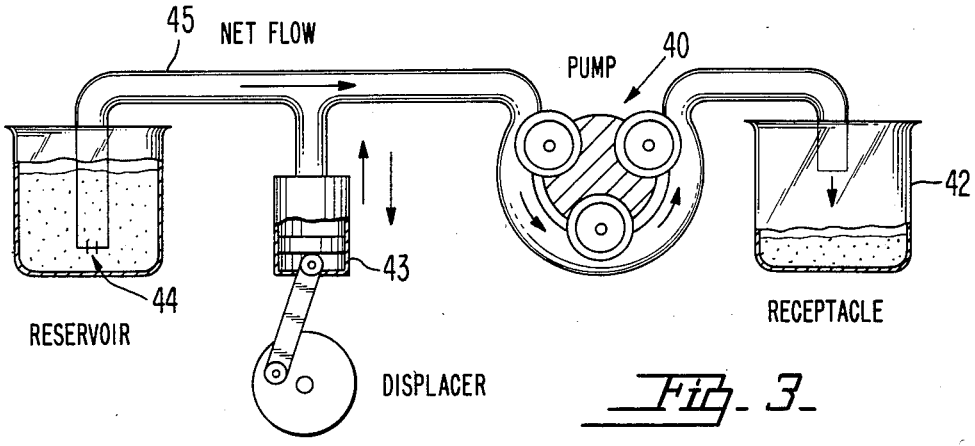
FIG. 3 is a schematic diagram of a second embodiment of the present invention.

These problems can be avoided by using a pump configuration of the type shown in FIG. 3. In this configuration, suction is generated by a positive displacement pump 40. Any type of positive displacement pump, including rotor pumps, gear pumps, and peristaltic pumps, which exhaust into an open receptacle 42, can be used. Since the pump 40 can handle fluids directly, the vacuum flask 24 of the type shown in FIG. 2 is not needed, and the problems which it introduced are eliminated. In addition, the open receptacle 42 can be emptied at any time. The pump 40 shown in FIG. 3 works, but it suffers from a problem in that the rotation rate of the suction pump 40 must be carefully controlled. If it is too slow, the transport rate of the fluid will be insufficient. If it is too fast, then the entire system will be evacuated, and the displacer 43 will have the effect of merely modulating the suction. Accordingly, the aperture 44 in the tubing 45 will promptly clog.

The problems noted above can be avoided by using the pumping system 50 of the preferred embodiment, as shown in FIG. 4. In this configuration, the alternate flow action is created by using a peristaltic pump 52 to generate both the suction and the pressure phases. The pump 52 of the preferred embodiment of the invention is comprised of two peristaltic heads 54, 56 which are ganged together in the proper phase. Alternatively, the pump 52 may have on peristaltic head with a wide roller which contacts two hoses. Since this configuration generates controlled pressure and suction pulses of fixed duration, it does not suffer from the over-suction problems of the earlier described embodiments of the invention. Further, since it exhausts into an open receptacle 58, it does not suffer from the disposal problem of the embodiment shown in FIG. 2. It should be noted, however, that while there are problems with these eariler embodiments, and while they are not preferred, for the noted reasons, they still fall within the inventive concept, and they may be preferred in specific applications.

The pumping system 50 of FIG. 4 works well provided that the ratio of the pressure phase duration provided by head 54 to the suction phase duration provided by head 56 is properly selected. Due to the different behavior of the systems under pressure and suction, it has been found preferable to have the suction phase disproportionately long compared to the pressure phase, i.e., approximately 3 to 1.

It has also been found that the system works best when the pressure and suction phases overlap. This has the effect of "lapping" the pump 52 during transition from pressure to suction, so that flow cannot occur due to gravitational effects, stored energy in compressed or rarified air pockets, or inertial flow. As shown in FIG. 5, it has been found that overlap angles of 15° work well.

It has also been found that the proper displacements for the pressure and suction phases of the pump 52 are dependent on fluid viscosity and density, and tubing bore size and length. For applications, which involve several feet of $\frac{1}{8}''$ or smaller bore tubing, it has been found that displacements of 3 ml (suction) and 1 ml (pressure), measured at low rotation rate and moderate restriction, work best.

The rotational rate of the pump affects both the net rate of transport of fluid, and the effectiveness of the alternate flow technique. For typical applications, it has been found that rotation rates which yield 3 to 5 alternation cycles per second provide good flow without clogging any apertures in the system.

Due to the tendency of the pump tubing to collapse during the suction cycle, the pressure cycle effect can be greatly enhanced by locating the pressure loop of the peristaltic pump closest to the reservoir and aperture, with the suction loop located closest to the exhaust, or receptacle.

It has also been found preferable to have all of the tubing 60 in the system have the thickest wall possible consistent with its function.

We claim:

1. A push-pull material transport system for moving debris-laden fluids from a first location to a second location comprising:

(a) a conduit for transporting the fluid from said first location to said second location;

(b) pump means comprising a peristaltic pump for moving the fluid through said conduit in a direction whose net flow is toward said second location; and (c) displacer means for intermittently and periodically imparting a flow direction toward said first location, said displacer means comprised of a peristaltic pump mounted along the longitudinal axis of a common drive shaft with said pump means so as to rotate said pump means and displacer means in a common direction, whereby any debris which is in said fluid will be dislodged from any apertures in said conduit.

2. The push-pull material transport system of claim 1 wherein said conduit is comprised of plastic tubing.

3. The push-pull material transport system of claim 2 wherein said plastic tubing is collapsible.

4. The push-pull material transport system of claim 1, wherein said pump means and said displacer means are comprised of a peristaltic pump having two heads.

5. The push-pull material transport system of claim 1 wherein said pump means and said displacer means are adjusted to provide overlapping outputs.

6. The push-pull material transport system of claim 5 wherein said overlapping outputs overlap for approximately 15 degrees during each transition in flow direction.

* * * * *